US010910761B2

(12) United States Patent
Nobukuni et al.

(10) Patent No.: US 10,910,761 B2
(45) Date of Patent: Feb. 2, 2021

(54) CONNECTOR HAVING A FERRITE AND A SEALING MEMBER

(71) Applicant: Sumitomo Wiring Systems, Ltd., Mie (JP)

(72) Inventors: Takashi Nobukuni, Mie (JP); Yuichi Goto, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/735,949

(22) Filed: Jan. 7, 2020

(65) Prior Publication Data

US 2020/0227859 A1 Jul. 16, 2020

(30) Foreign Application Priority Data

Jan. 15, 2019 (JP) ..... 2019-004505

(51) Int. Cl.
*H01R 13/7193* (2011.01)
*H01R 13/52* (2006.01)

(52) U.S. Cl.
CPC ..... *H01R 13/5202* (2013.01); *H01R 13/7193* (2013.01)

(58) Field of Classification Search
CPC ..... H01R 13/7193; H01R 13/7195; H01R 13/7197; H01R 13/6585; H01R 13/521
See application file for complete search history.

(56) References Cited

U.S. PATENT DOCUMENTS 3,743,979 A * 7/1973 Schor ..... H01R 13/7197 333/183
4,747,789 A * 5/1988 Gliha ..... H01R 13/7197 333/185
5,551,893 A * 9/1996 Johnson ..... H01R 13/521 333/182
2013/0303023 A1 11/2013 Miwa et al.
2014/0045381 A1* 2/2014 Tsukamoto ..... H01R 31/08 439/626

FOREIGN PATENT DOCUMENTS

JP 2012-69270 4/2012

* cited by examiner

*Primary Examiner* — Tho D Ta
(74) *Attorney, Agent, or Firm* — Gerald E. Hespos; Michael J. Porco; Matthew T. Hespos

(57) ABSTRACT

It is aimed to suppress water intrusion into an internal accommodation space for accommodating a ferrite and the adhesion of water to a male terminal by providing a sealing member. A connector (10) includes an inner housing (16), an outer housing 14 including a rear receptacle (30) into which the inner housing (16) is fit, and ferrites (12) including ferrite-side insertion holes (48) through which busbars (18) are inserted. The ferrites (12) are accommodated into internal accommodation spaces (S) formed inside by the inner housing (16) and the rear receptacle (30) in a fit state. A sealing member (20) is sandwiched between the rear receptacle (30) and the inner housing (16) to suppress water intrusion into the internal accommodation spaces (S).

2 Claims, 15 Drawing Sheets

CONNECTOR HAVING A FERRITE AND A SEALING MEMBER

BACKGROUND

Field of the Invention

This specification relates to a connector.

Related Art

Japanese Unexamined Patent Publication No. 2012-69270 discloses a connector that includes first and second housings made of synthetic resin, two conductive members and ferrites provided in these conductive members to remove noise from terminals.

The two conductive members and the ferrites are held in the second housing, and the first housing is provided with an accommodating portion for accommodating the second housing.

The above-described connector is a non-waterproof connector and is not intended for use in an environment exposed to water. Use of the connector in an environment exposed to water risks intrusion of water through a clearance between the first and second housings.

SUMMARY

A connector disclosed in this specification is provided with an inner housing and an outer housing including a receptacle into which the inner housing is fit. A ferrite is accommodated in an internal accommodation space formed inside by the inner housing and the receptacle in a fit state. The ferrite includes an insertion hole through which a male terminal is inserted. A sealing member is sandwiched between the receptacle and the inner housing to suppress water intrusion into the internal accommodation space. The sealing member prevents intrusion of water into the internal accommodation space and the adhesion of water to the male terminal.

Further, the sealing member may include plural ferrite accommodating portions for accommodating plural ferrites inside. A first sealing portion may be held in contact with an inner peripheral surface of the receptacle over an entire periphery, and a second sealing portion in the form of a frame may collectively surround openings of the ferrite accommodating portions. The second sealing portion may be held in contact with a fitting surface of the inner housing over an entire periphery.

The first sealing portion may cut-off water in a path from an opening of the receptacle to a fitting surface of the receptacle, and the second sealing portion may cut-off water in a path from the opening of the receptacle to the fitting surface of the inner housing. Thus, one sealing member cuts-off water in two paths.

The inner housing may have plural ferrite accommodating portions to accommodate plural ferrites inside, and a sealing member fitting portion may be provided on an outer periphery of the inner housing. The sealing member may be fit to the sealing member fitting portion, to sandwich the sealing member over an entire periphery by an inner peripheral surface of the receptacle and a bottom surface of the sealing member fitting portion.

Water cut-off in the path from the opening of the receptacle to the fitting surface of the receptacle and water cut-off in the path from the opening of the receptacle to the fitting surface of the inner housing can be realized simultaneously by fitting the sealing member to the bottom surface of the sealing member fitting portion.

According to the connector disclosed in this specification, the sealing member prevents water intrusion into the internal accommodation space for accommodating the ferrite and the adhesion of water to the male terminal.

DETAILED DESCRIPTION

Figure 4:
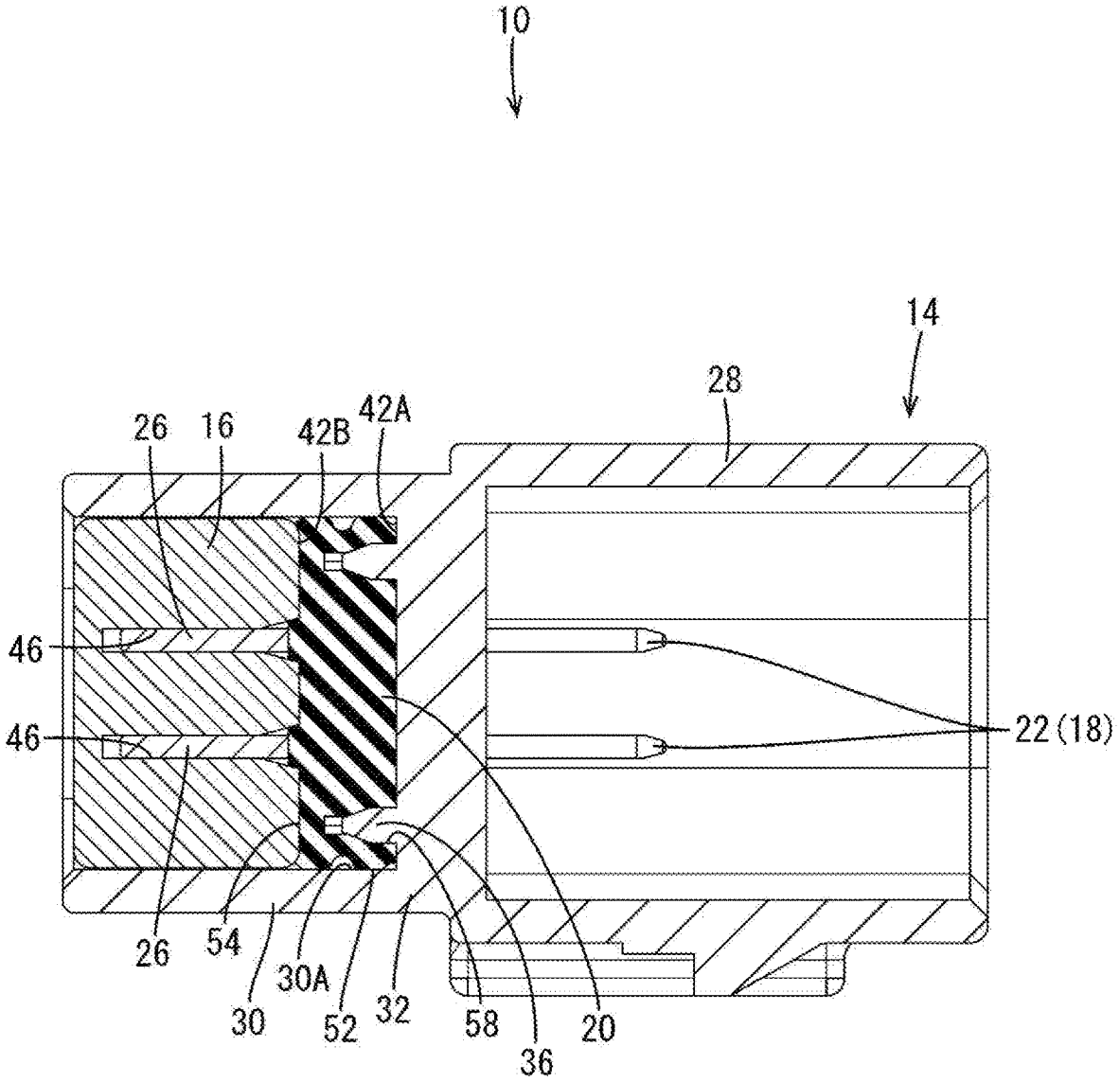
FIG. 4 is a section along B-B in FIG. 2.
Figure 5:
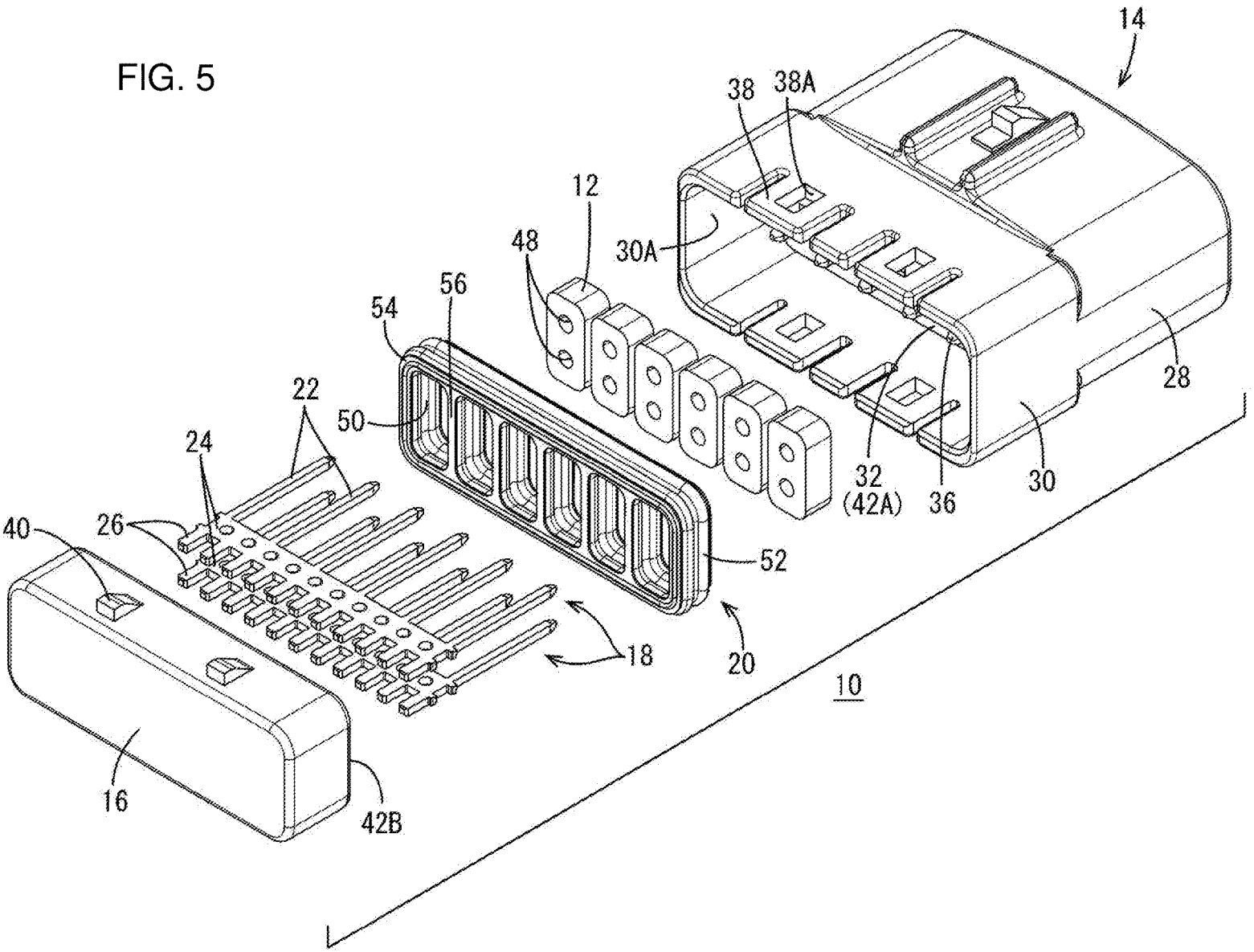
FIG. 5 is an exploded perspective view of the connector.

A connector 10 of a first embodiment is described with reference to FIGS. 1 to 10. The connector 10 is a waterproof joint connector and includes, as shown in FIG. 5, ferrites 12 (six in this embodiment) for noise removal, outer and inner housings 14 and 16 made of resin, a sealing member 20 made of soft synthetic rubber and two busbars (male terminals) 18 made of conductive metal. The sealing member 20 is a rectangular frame long in a lateral direction. In the following description, a direction from the lower busbar 18 to the upper busbar 18 in FIG. 5 is referred to as an upward direction, a direction from a rear receptacle 30 to a front receptacle 28 in FIG. 5 is referred to as a forward direction along a front-rear direction, and a direction from the ferrite 12 on a front side to the ferrite 12 on a back side in FIG. 5 is referred to as a leftward direction along a lateral direction.

As shown in FIG. 5, the busbar 18 includes connecting portions 22 in the form of bars long in the front-rear direction and disposed at predetermined intervals in the lateral direction. A coupling 24 couples rear parts of the connecting portions 22 and electrically connects the plurality of connecting portions 22 to one another. Fixing portions 26 project rearward from the coupling 24 and are disposed at predetermined intervals in the lateral direction. The two busbars 18 are at a predetermined interval in the vertical direction. One of the two busbars 18 is used for signals and the other is used for grounding.

Figure 3:
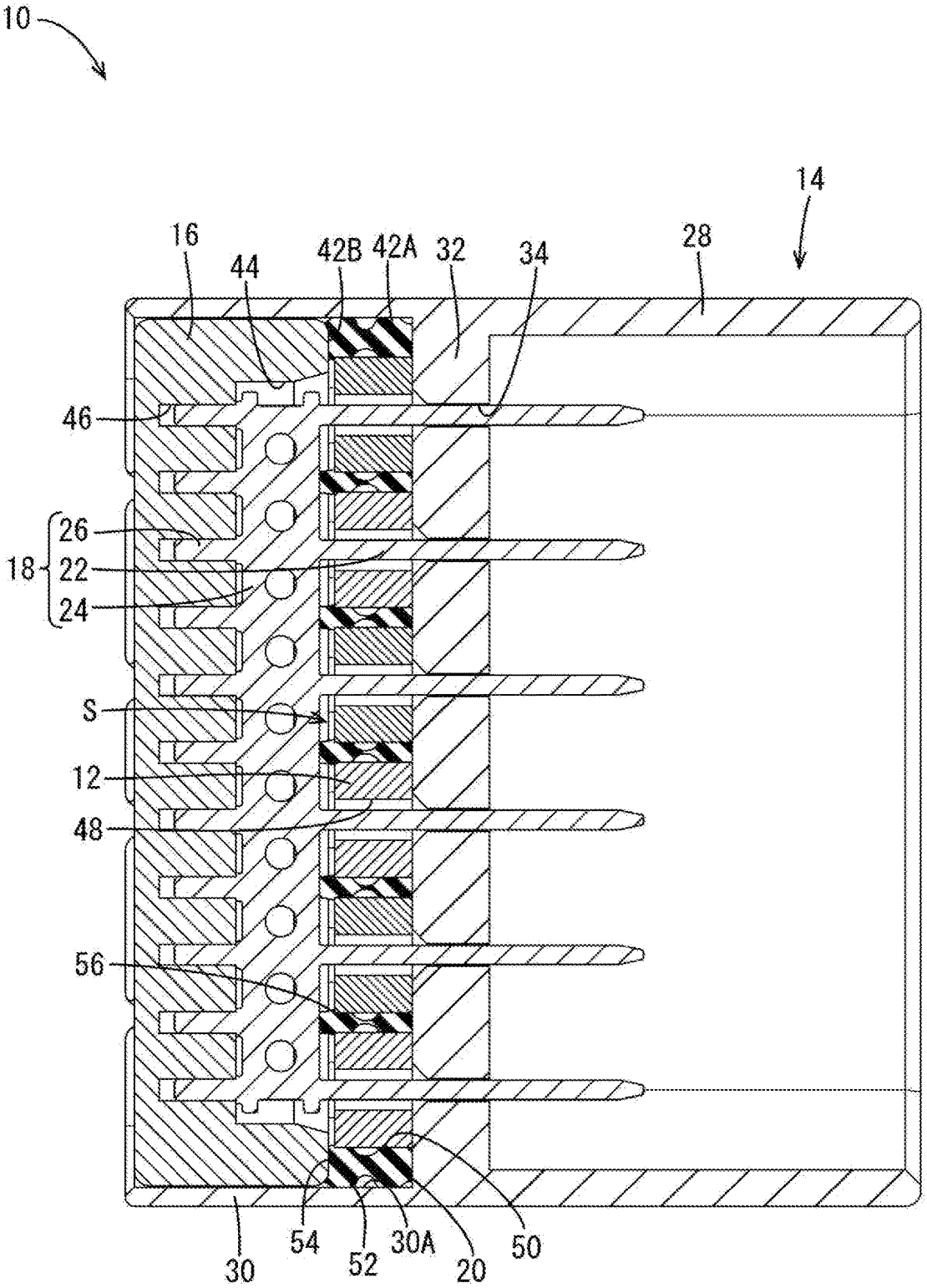
FIG. 3 is a section along A-A in FIG. 2.

As shown in FIG. 3, the outer housing 14 is a forwardly open receptacle and includes the front receptacle 28 into which a mating connector (not shown) is finable, the rear receptacle 30 into which the inner housing 16 is finable, and a plate-like bottom wall 32 between a rear surface in the front receptacle 28 and a front surface in the rear receptacle 30.

Figure 6:
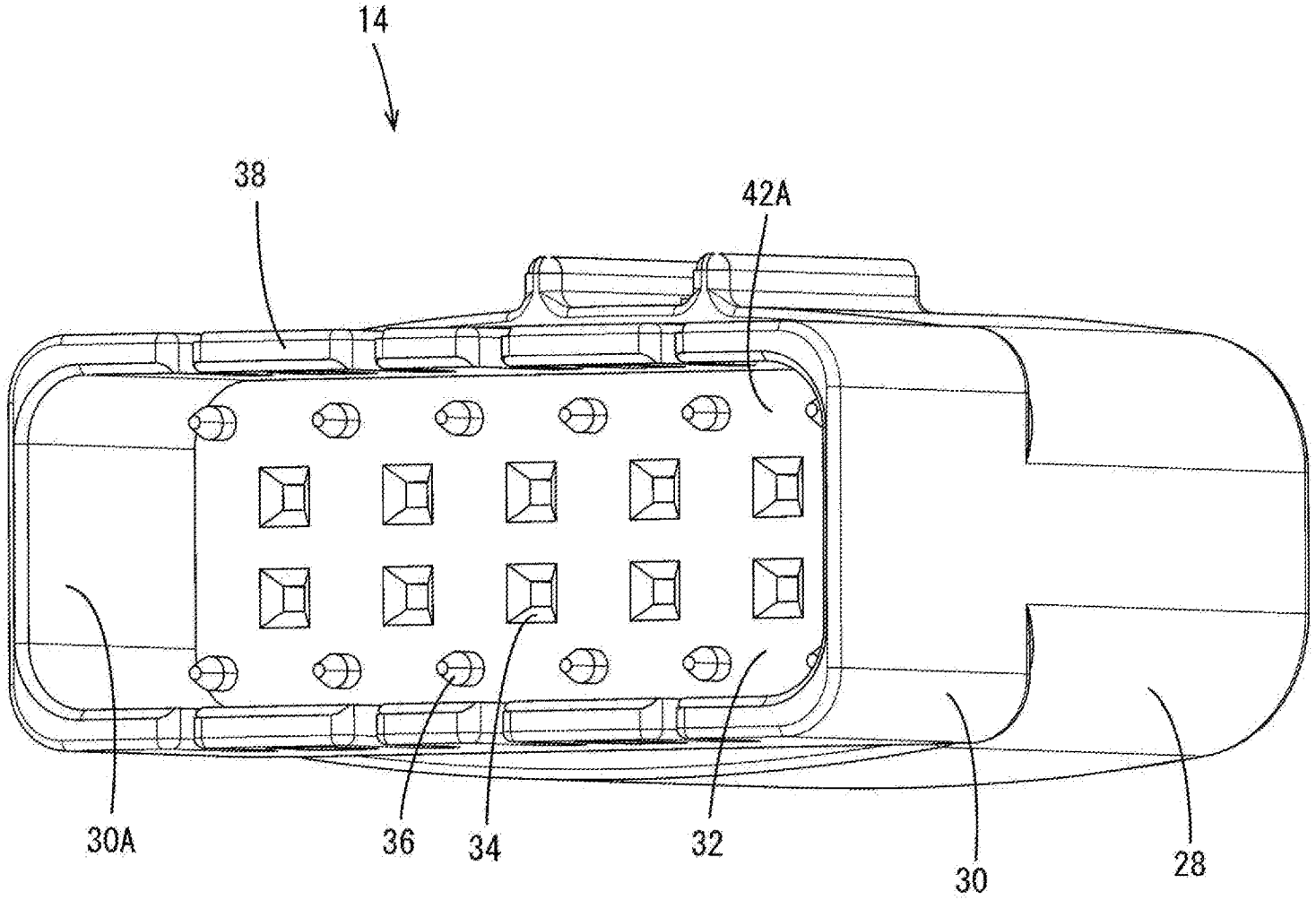
FIG. 6 is a perspective view of an outer housing.

As shown in FIG. 3, a plurality of housing-side insertion holes 34 through which the connecting portions 22 of the busbars 18 are inserted are provided to penetrate through the bottom wall 32 in the front-rear direction. Further, as shown in FIG. 6, a plurality of pins 36 are provided to project side by side in the lateral direction in two upper and lower rows on the front surface in the rear receptacle 30.

Slits extend forward from a rear opening edge of a peripheral wall of the rear receptacle 30, as shown in FIG. 5, and a lock arm 38 is provided between two adjacent slits. The lock arm 38 is resiliently displaceable in the vertical direction. Four lock arms 38 are formed in this embodiment. A lock hole 38A is open in each lock arm 38.

As shown in FIG. 5, the inner housing 16 has a rectangular shape long in the lateral direction, and is accommodated into the rear receptacle 30 of the outer housing 14 together with a sealing member 20 to be described later.

Figure 1:
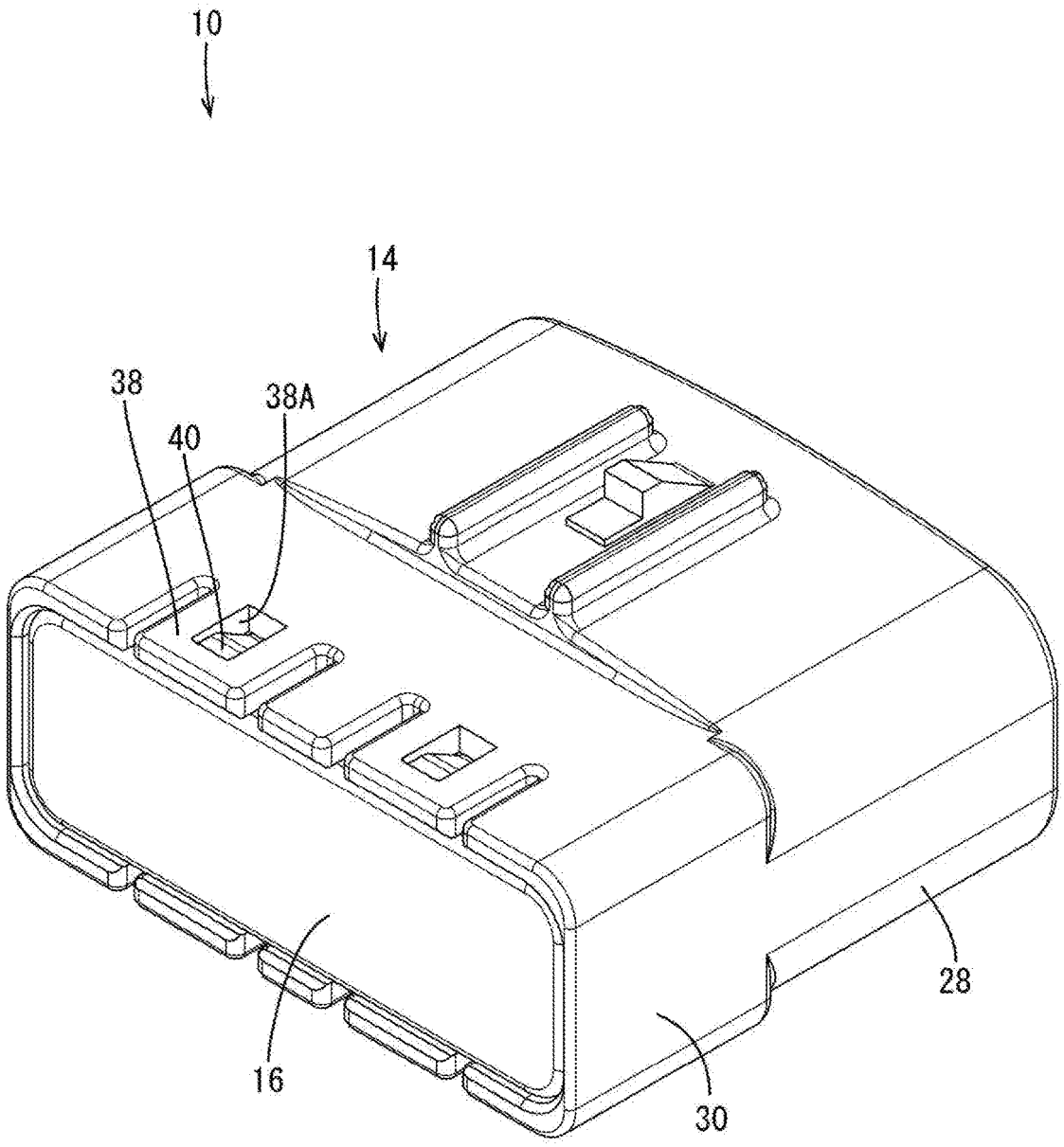
FIG. 1 is a perspective view of a connector in a first embodiment.
Figure 2:
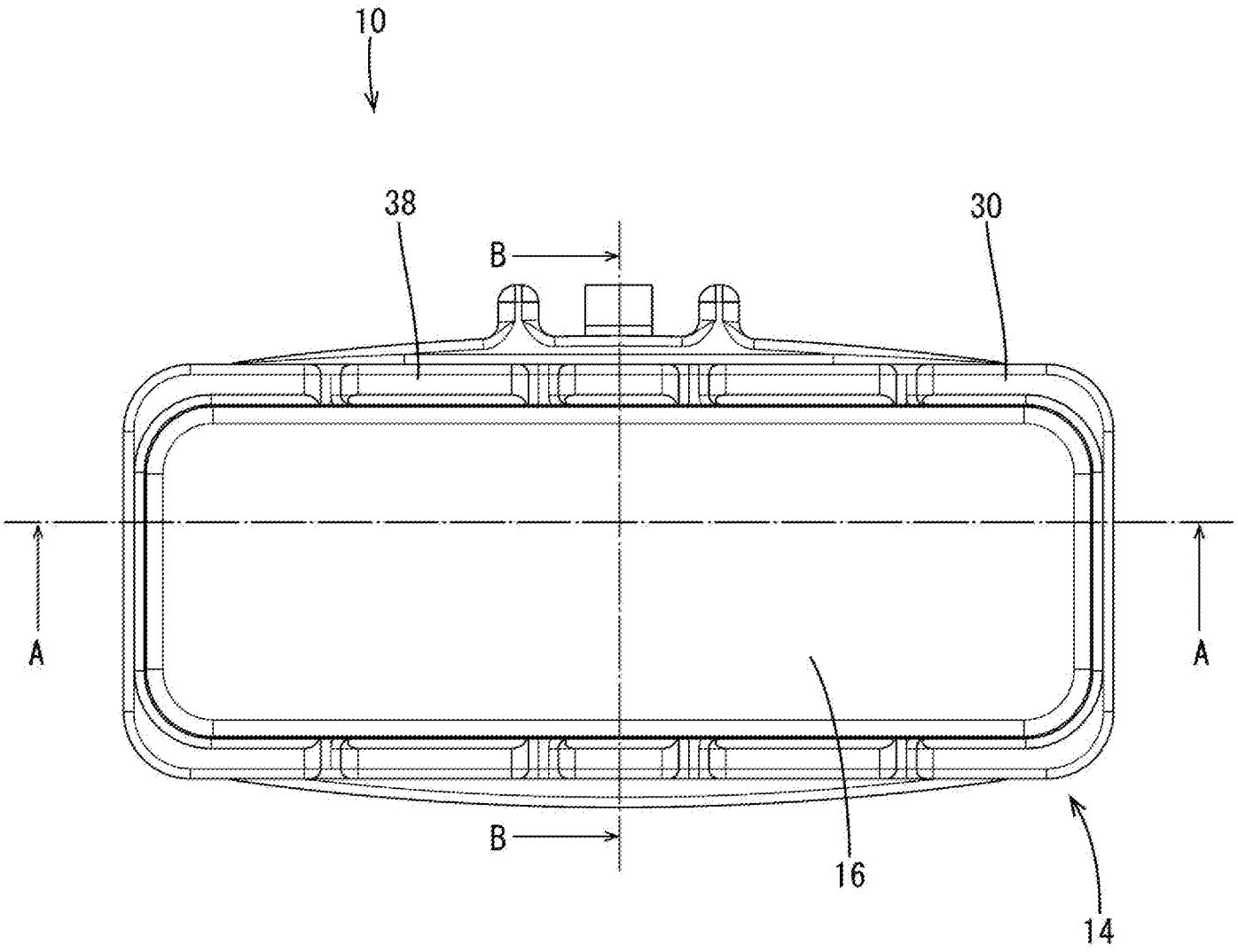
FIG. 2 is a back view of the connector.

As shown in FIG. 5, locks 40 project at positions on the outer peripheral surface of the inner housing 16 corresponding to the lock arms 38 of the rear receptacle 30. When the inner housing 16 is accommodated into the rear receptacle 30 of the outer housing 14, the locks 40 are accommodated into the lock holes 38A of the lock arms 38, as shown in FIG. 1. The locks 40 are located to contact inner walls of the lock holes 38A, and the inner housing 16 is fit in the rear receptacle 30 of the outer housing 16 (fit state). If the inner housing 16 is going to be displaced rearward in this fit state, the lock portions 40 contact the inner walls of the lock holes 38A from the front to suppress a rearward escape of the inner housing 16 from the inside of the rear receptacle 30.

As shown in FIG. 3, the rear surface of the bottom wall 32 of the outer housing 14 and the front surface of the inner housing 16 define a fitting surface 42A and a fitting surface 42B held in contact through the sealing member 20 to be described later in the fit state of the inner housing 16.

Figure 9:
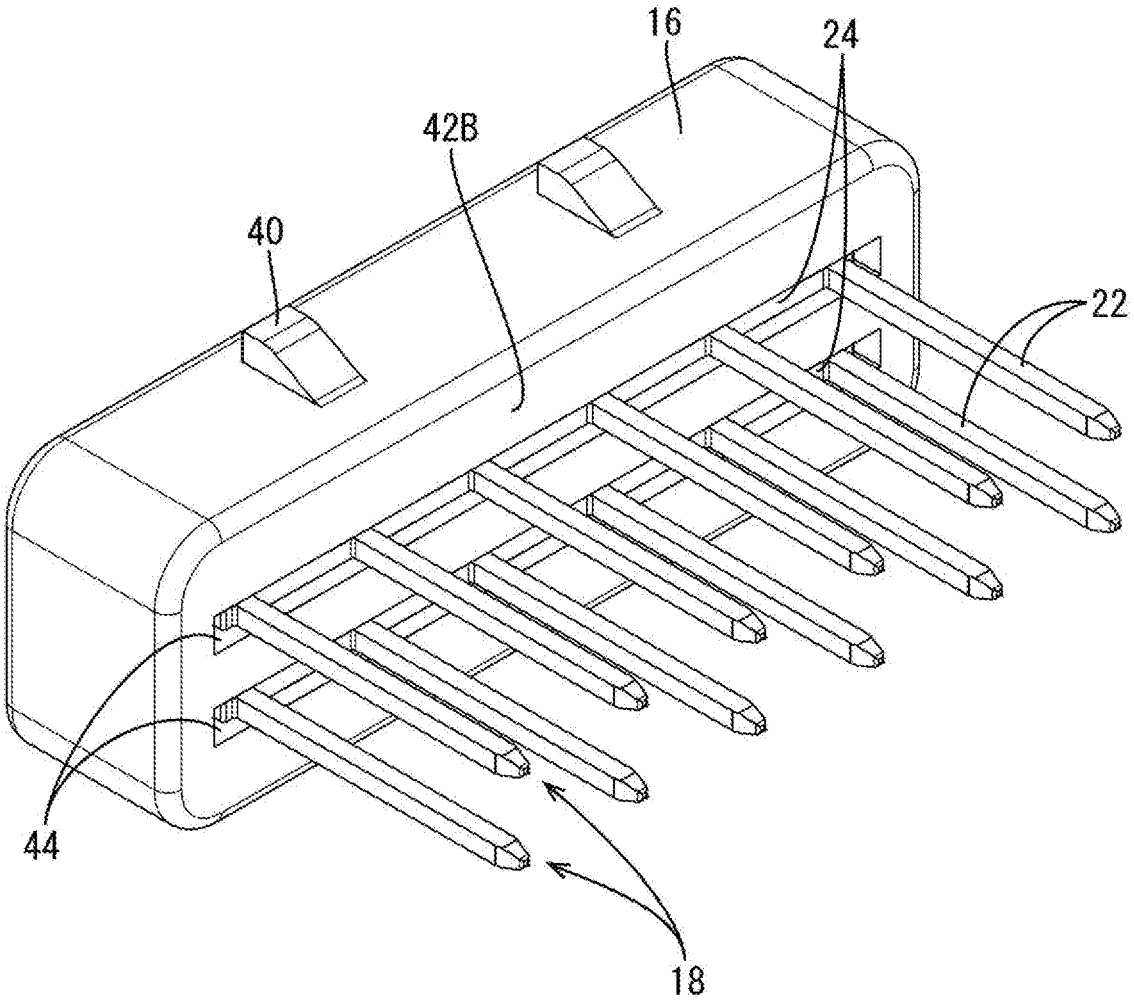
FIG. 9 is a perspective view of an inner housing in a state where busbars are mounted.
Figure 10:
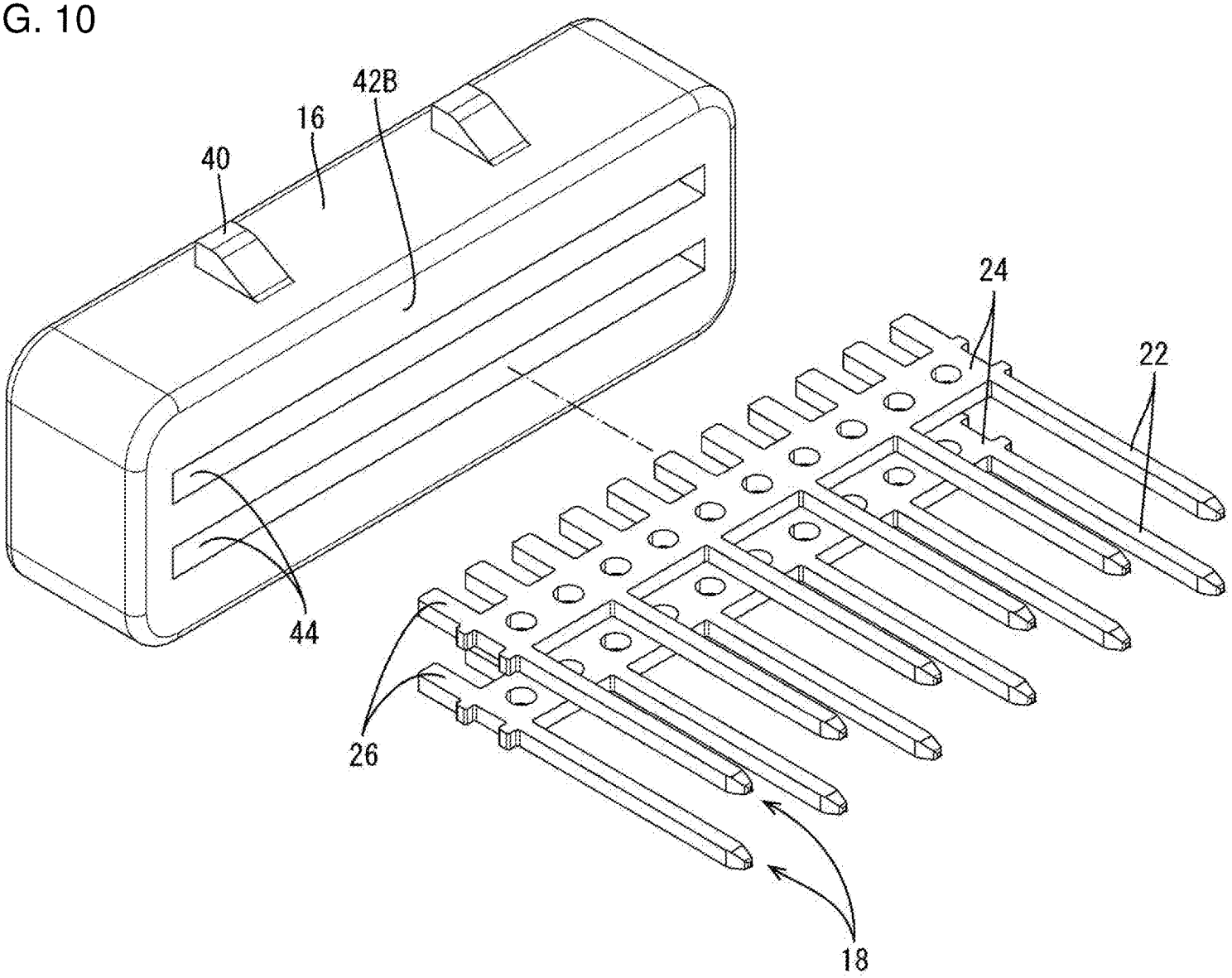
FIG. 10 is a perspective view of the inner housing in a state where the busbars are separated.
Figure 11:
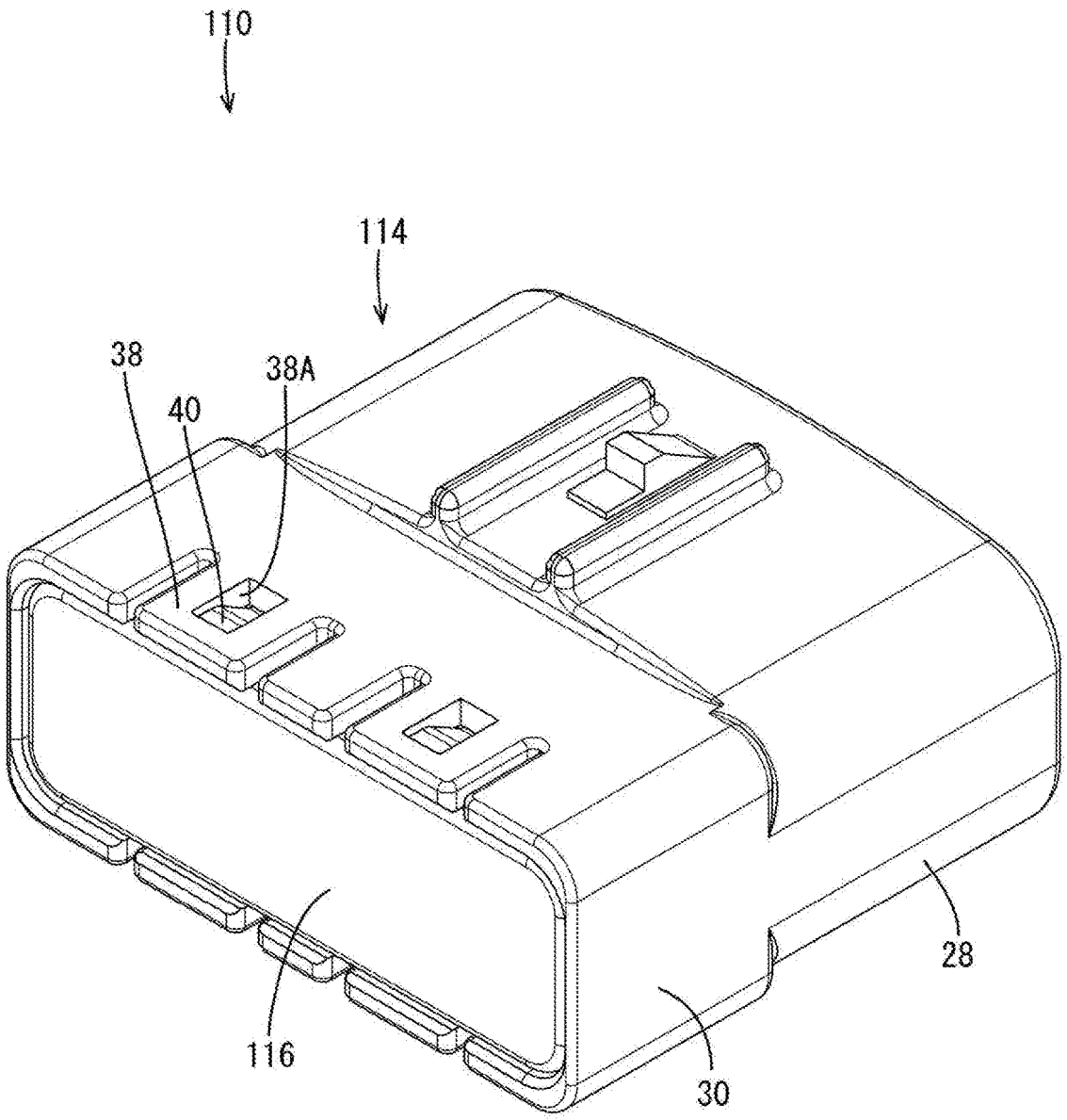
FIG. 11 is a perspective view of a connector in a second embodiment.
Figure 12:
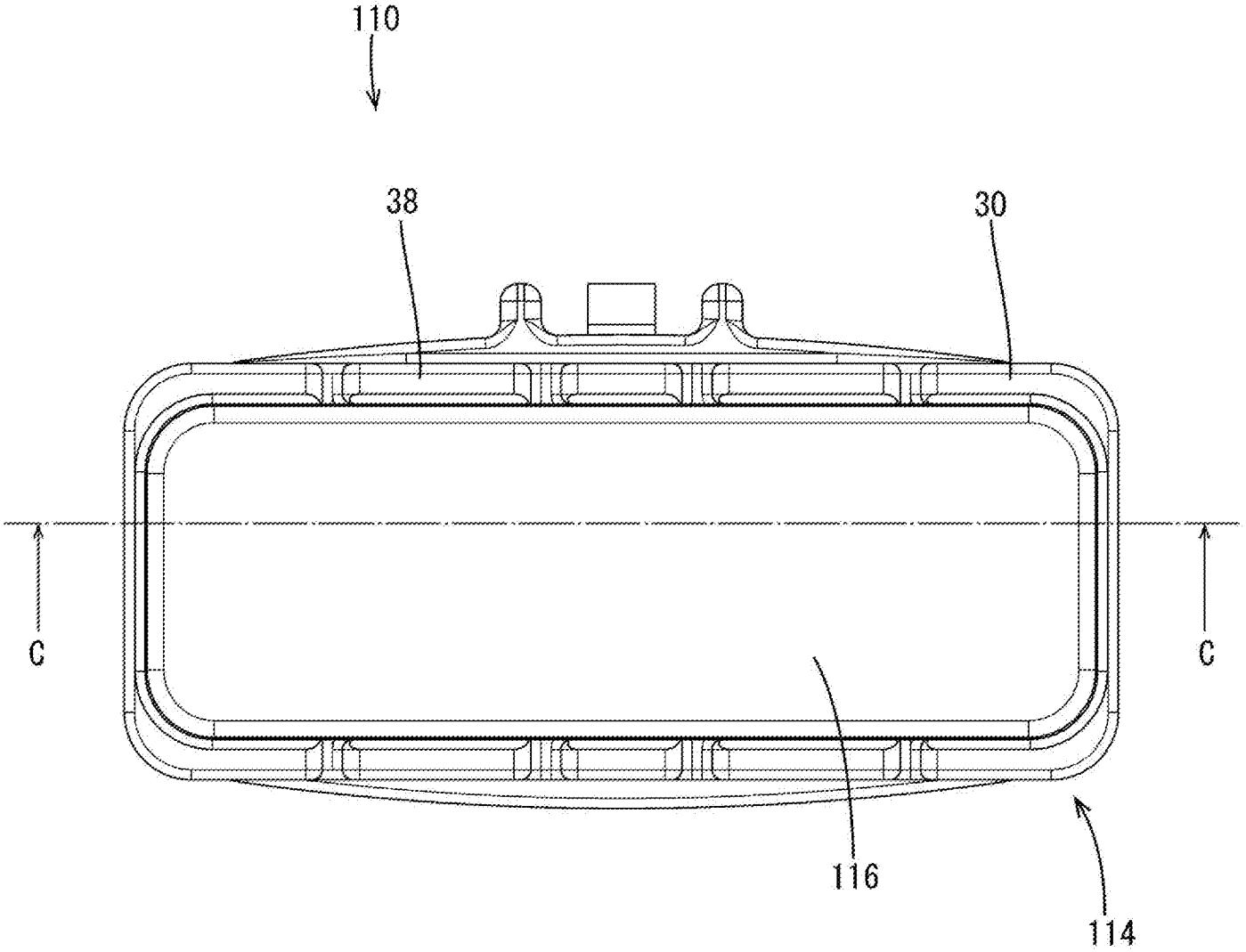
FIG. 12 is a back view of the connector.

As shown in FIG. 9, two laterally long accommodation grooves 44 are provided in the fitting surface 42B of the inner housing 16. The accommodation grooves 44 are disposed at a predetermined interval in the vertical direction and are configured to accommodate the couplings 24 of the two busbars 18. As shown in FIG. 3, fixing holes 46 are open in the bottom surface of the accommodation groove 44 and the fixing portions 26 of the busbar 18 are press-fit respectively therein.

As shown in FIG. 5, the ferrite 12 has a rectangular shape with rounded corners, and includes two ferrite-side insertion holes (insertion holes) 48 into which the connecting portions 22 of the two busbars 18 are inserted respectively. The two ferrite-side insertion holes 48 are disposed at a predetermined interval in the vertical direction, and penetrate from the front surface to the rear surface of the ferrite 12.

As shown in FIG. 5, the sealing member 20 includes ferrite accommodating portions 50 for individually accommodating the ferrites 12. A lip-like first sealing portion 52 projects out from the outer periphery of the sealing member 20, and a frame-like second sealing portion 54 projects rearward from a rear opening edge of the sealing member 20 for collectively surrounding openings of the ferrite accommodating portions 50. With the ferrites 12 accommodated in the ferrite accommodating portions 50 (FIGS. 7 and 8), the sealing member 20 is accommodated in the rear receptacle 30 of the outer housing 14.

Figure 7:
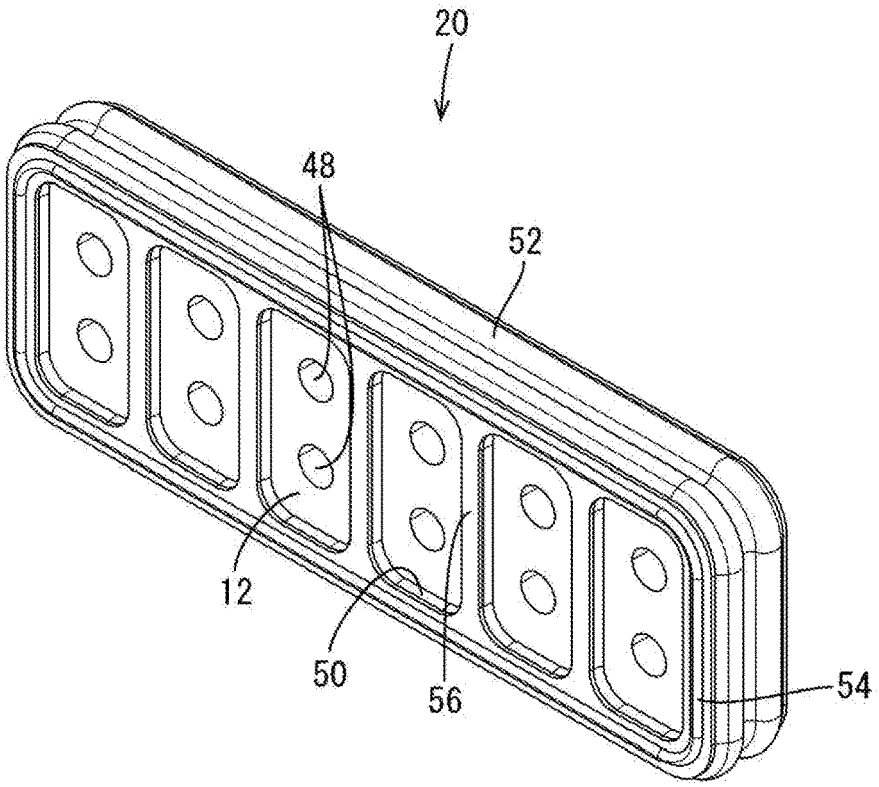
FIG. 7 is a rear perspective view of a sealing member in a state where ferrites are accommodated.
Figure 8:
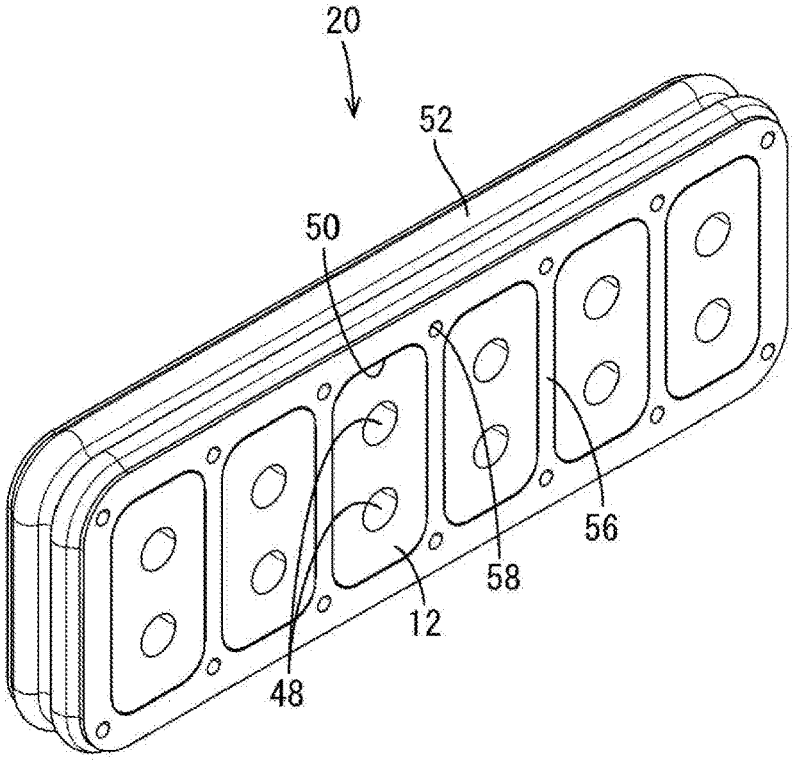
FIG. 8 is a front perspective view of the sealing member in the state where the ferrites are accommodated.

As shown in FIGS. 7 and 8, the ferrite accommodating portions 50 are disposed side by side in the lateral direction, with partition walls 56 between adjacent ferrite accommodating portions 50. When the ferrites 12 are accommodated into the ferrite accommodating portions 50, the ferrites 12 contact the inner walls of the ferrite accommodating portions 50 to be held in the ferrite accommodating portions 50.

As shown in FIG. 8, positioning holes 58 are provided in the front surface of the sealing member 20. As shown in FIG. 4, the positioning holes 58 are at positions corresponding to the pins 36 provided on the bottom wall 32 of the outer housing 14. When the sealing member 20 is accommodated in the rear receptacle 30, the pins 36 enter the positioning holes 58 to position the sealing member 20 in the rear receptacle 30.

The inner housing 16 is fit into the rear receptacle 30 with the sealing member 20 in the rear receptacle 30 as shown in FIG. 3. Thus, front and rear openings of the ferrite accommodating portions 50 are sandwiched by the fitting surfaces 42A and 42B, and internal accommodation spaces S are formed in the connector 10 for accommodating the ferrites 12. At this time, the first sealing portion 52 is in contact with an inner peripheral surface 30A of the rear receptacle 30 over the entire periphery to cut off water in a path from the opening of the rear receptacle 30 to the fitting surface 42A in the outer housing 14. Further, the second sealing portion 54 is in contact with the fitting surface 42B of the inner housing 16 over the entire periphery to cut off water in a path from the opening of the rear receptacle 30 of the outer housing 14 to the fitting surface 42B of the inner housing 16. Thus, water cut-off in two paths is achieved by one sealing member 20 and water intrusion into the internal accommodation spaces S and the adhesion of water to the busbars 18 can be suppressed.

Further, the sealing member 20 may include: the ferrite accommodating portions 50 for accommodating the ferrites 12 inside; the first sealing portion 52 to be held in contact with the inner peripheral surface 30A of the rear receptacle 30 over the entire periphery; and the second sealing portion 54 in the form of a frame collectively surrounding the openings of the ferrite accommodating portions 50 and to be held in contact with the fitting surface 42B of the inner housing 16 over the entire periphery.

Water cut-off in the path from the opening of the rear receptacle 30 to the fitting surface 42A of the rear receptacle 30 can be performed by the first sealing portion 52, and water cut-off in the path from the opening of the rear receptacle 30 to the fitting surface 42B of the inner housing 16 can be performed by the second sealing portion 54. Thus, water cut-off in the two paths can is achieved by one sealing member 20.

Second Embodiment

A connector 110 of a second embodiment is described with reference to FIGS. 11 to 17. The connector 110 differs from the connector 10 of the first embodiment in the shapes of an outer housing 114, an inner housing 116 and a sealing member 200. Note that the same components as those of the connector 10 are denoted by the same reference signs as the connector 10 of the first embodiment in FIGS. 11 to 17 and are not described.

Figure 14:
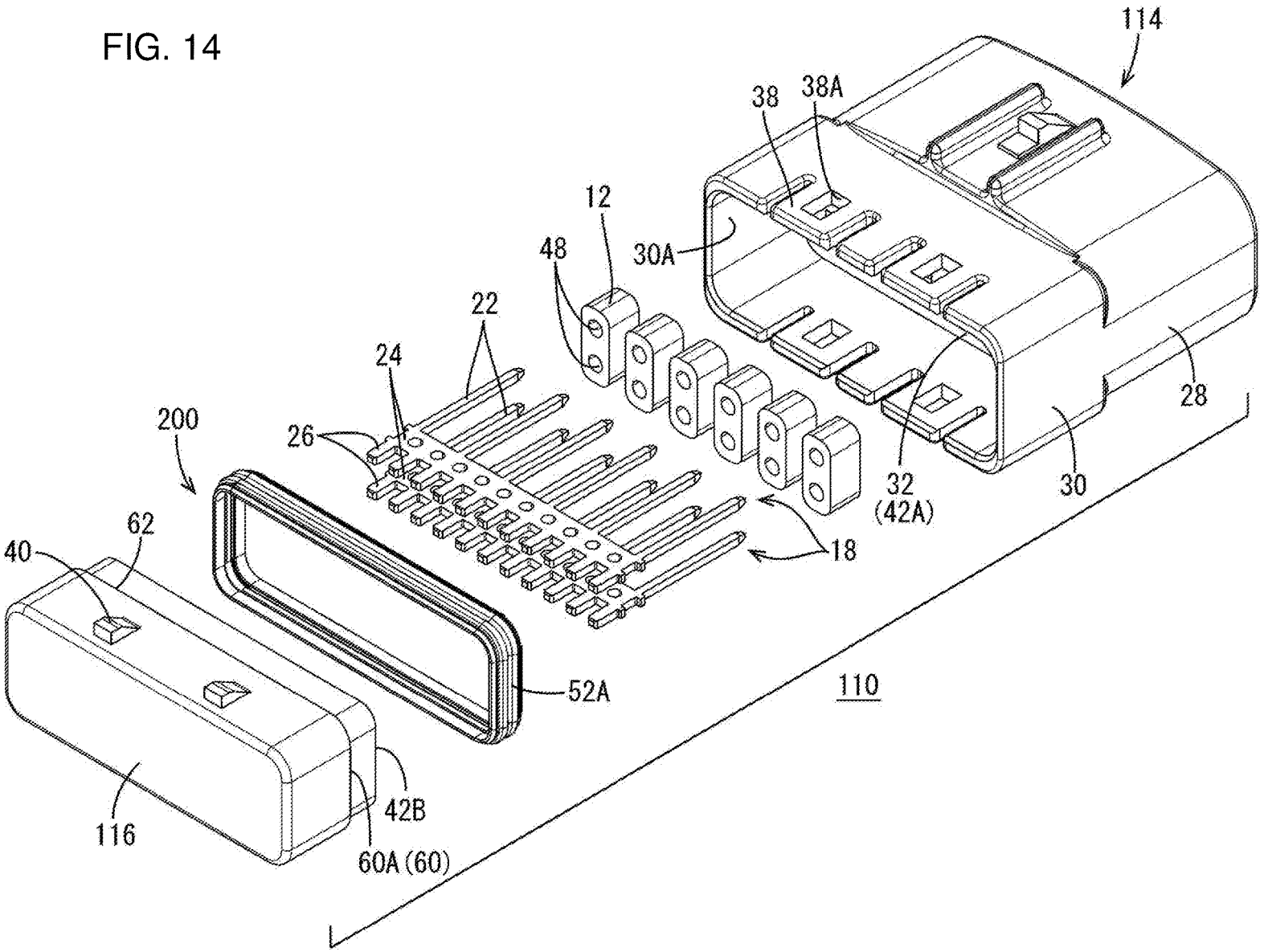
FIG. 14 is an exploded perspective view of the connector.
Figure 15:
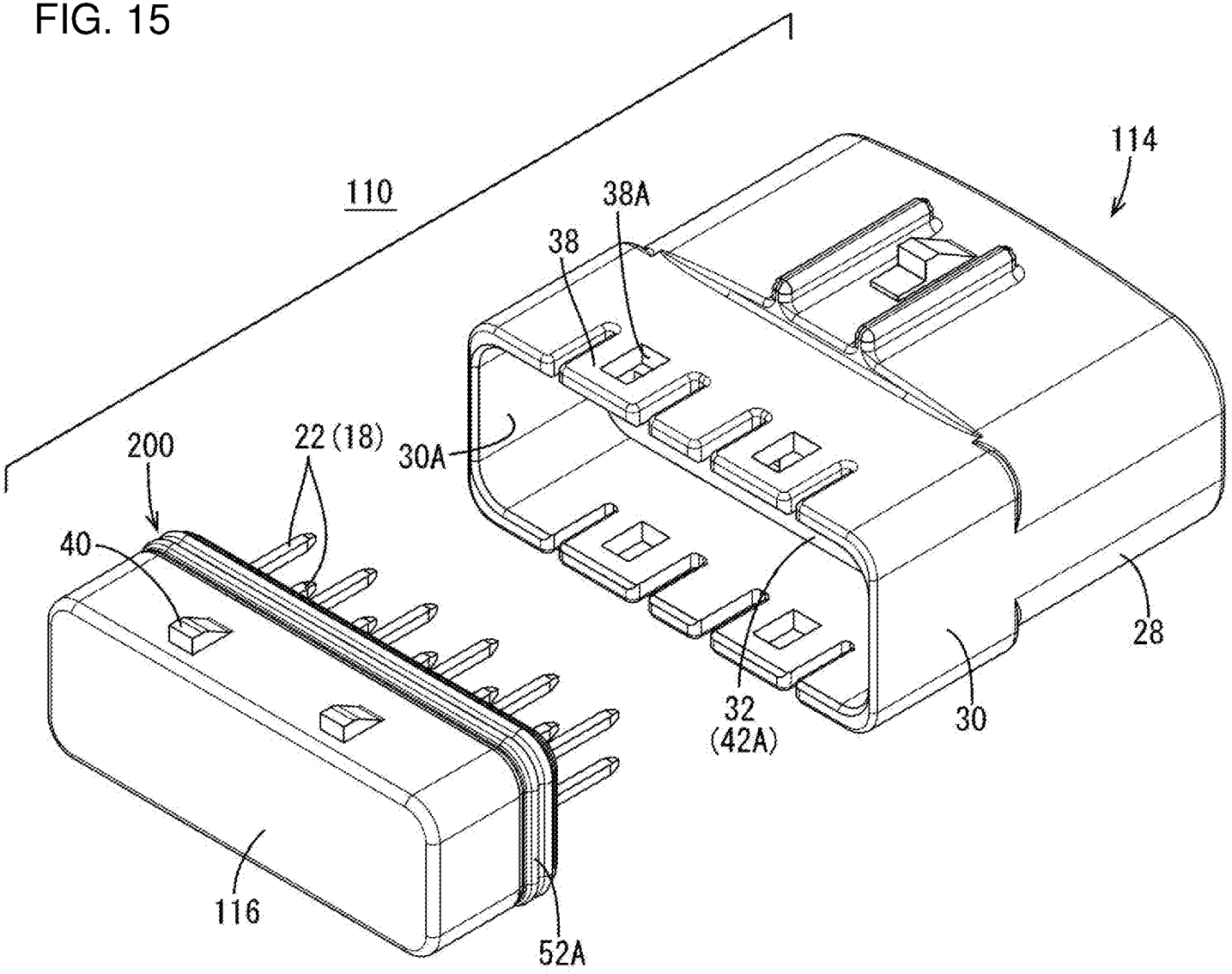
FIG. 15 is a view showing a state where inner and outer housings are separated.

As shown in FIGS. 14 and 15, the outer housing 114 differs from the outer housing 14 of the first embodiment in that the pins 36 for positioning are not provided.

As shown in FIG. 14, the sealing member 200 is in the form of a rectangular frame and a lip-like projecting first sealing portion 52A is provided on the outer peripheral surface of the sealing member 200.

Figure 17:
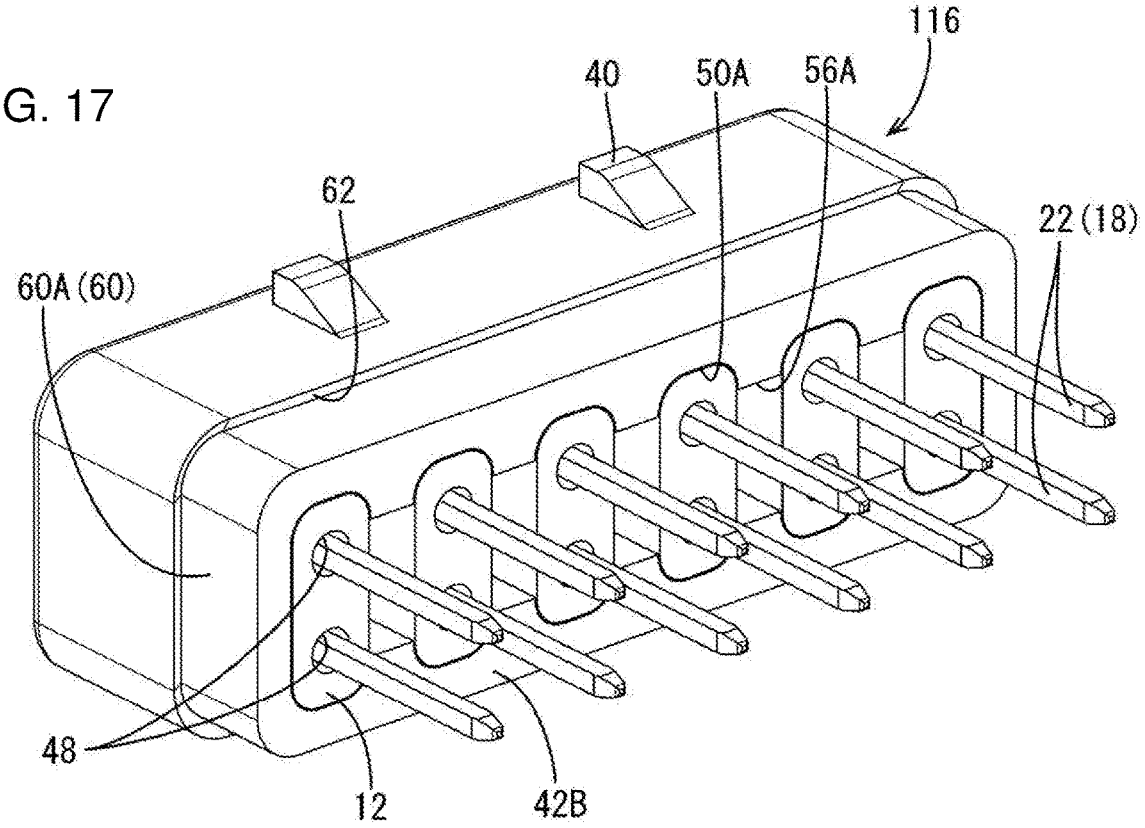
FIG. 17 is a perspective view of the inner housing with a sealing member removed.

As shown in FIG. 14, the inner housing 116 has a rectangular shape long in a lateral direction and a groove-like sealing member fitting portion 60 is provided in the outer periphery of a front part of the inner housing 116 to receive the sealing member 200. As shown in FIG. 17, a bottom surface 60A of the sealing member fitting portion 60 (i.e. outer peripheral surface of the front part of the inner housing 116 and the outer peripheral surface of a rear end side of the inner housing 116 are connected via a step 62. In this way, the size of the outer periphery of the sealing member 200 can be suppressed when the sealing member 200 is fit to the sealing member fitting portion 60, as compared to the case where the step 62 is not provided. Thus, the enlargement of an opening of a rear receptacle 30 of the outer housing 114 is suppressed.

Figure 16:
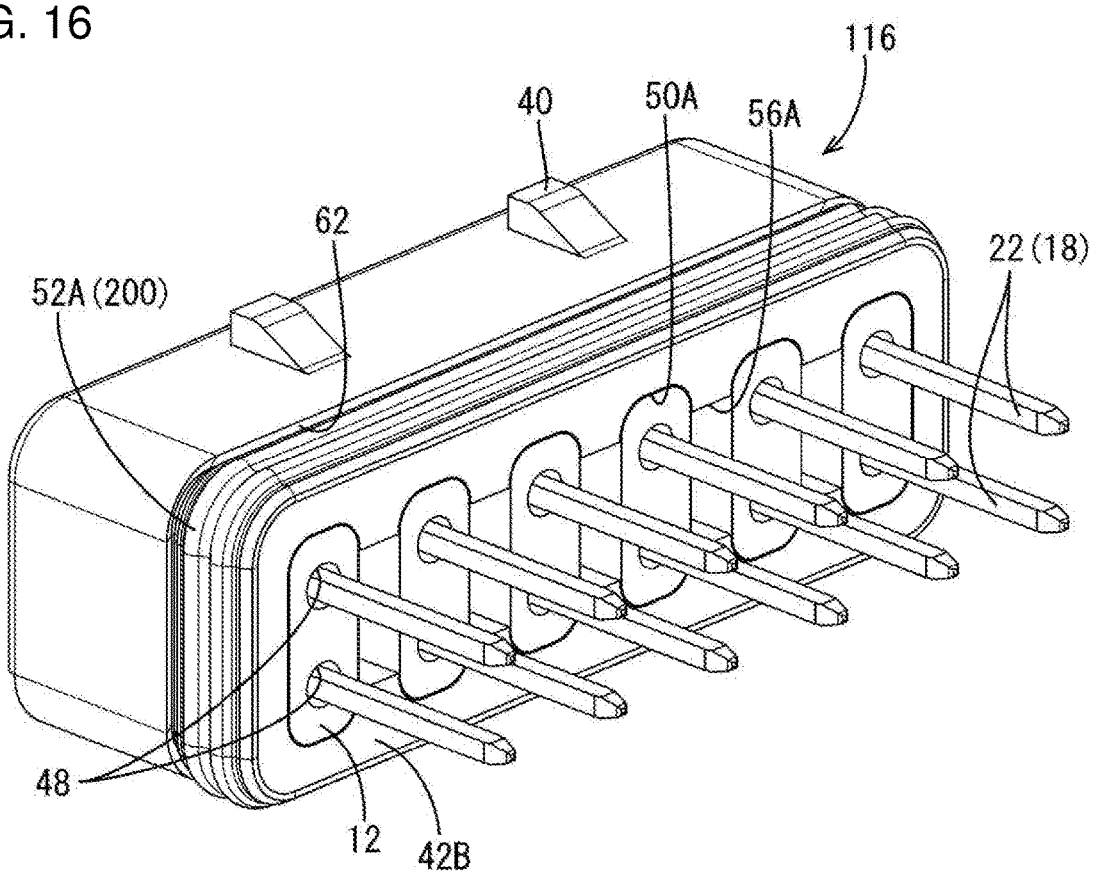
FIG. 16 is a perspective view of the inner housing.

As shown in FIGS. 16 and 17, ferrite accommodating portions 50A are open in a fitting surface 42B of the inner housing 116 and partition wall 56A separate adjacent ferrite accommodating portions 50A. The partition wall 56A is cut in a central part so that the insides of the adjacent ferrite accommodating portions 50A communicate with each other.

Figure 13:
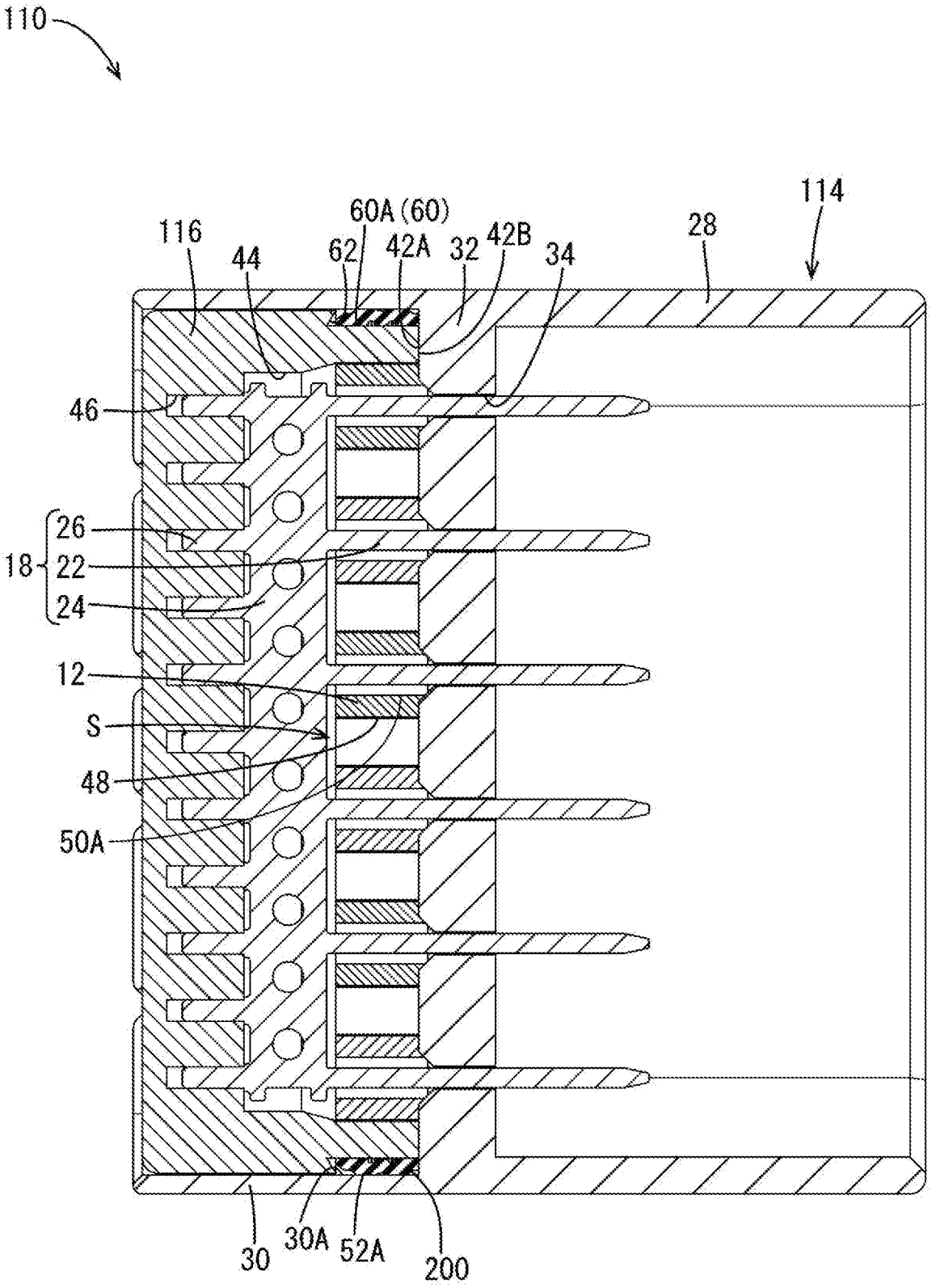
FIG. 13 is a section along C-C in FIG. 12.

As shown in FIG. 13, accommodation grooves 44 for accommodating coupling portions 24 of busbars 18 are provided in the bottom surfaces of the ferrite accommodating portions 50A, and fixing holes 46 into which fixing portions 26 of the busbars 18 are respectively press-fit are open in the bottom surfaces of the accommodation grooves 44, as in the first embodiment. Ferrites 12 are accommodated into the ferrite accommodating portions 50 with the busbars 18 accommodated in the accommodation grooves 44.

The inner housing 116 is accommodated into the rear receptacle 30 as shown in FIG. 13, and the sealing member 200 is sandwiched over the entire periphery by an inner peripheral surface 30A of the rear receptacle 30 and the bottom surface 60A of the sealing member fitting portion 60. In this way, water cut-off in a path from an opening of the rear receptacle 30 to a fitting surface 42A of the rear receptacle 30 and water cut-off in a path from the opening of the rear receptacle 30 to the fitting surface 42B of the inner housing 116 can be achieved simultaneously by fitting the sealing member 200 to the bottom surface 60A of the sealing member fitting portion 60.

The invention is not limited to the above described and illustrated embodiments. For example, the following various modes also are included.

Although there are six ferrites 12 in the first and second embodiments, the number of the ferrites 12 is not limited and five or less or seven or more ferrites may be used.

Although the connector 10, 110 is a waterproof joint connector and the busbars 18 including the plurality of connecting portions 22 are male terminals in the above first and second embodiments, a connector may be a general connector including general male terminals each having one connecting portion.

Although the sealing member 200 is in the form of a rectangular frame in the second embodiment, a sealing member may be, for example, in the form of a circular frame, and a rear receptacle may be in the form of a hollow cylinder and a sealing member fitting portion of an inner housing may be in the form of a hollow cylinder in conformity with the shape of the sealing member.

LIST OF REFERENCE SIGNS

10, 110: connector
12: ferrite
14, 114: outer housing
16, 116: inner housing
18: busbar (male terminal)
20, 200: sealing member
30: rear receptacle (receptacle)
30A: inner peripheral surface
42A, 42B: fitting surface
48: ferrite-side insertion hole (insertion hole)
50, 50A: ferrite accommodating portion
52, 52A: first sealing portion
54: second sealing portion
60: sealing member fitting portion
60A: bottom surface
S: internal accommodation space

What is claimed is:

1. A connector, comprising:

an inner housing including ferrite accommodating portions and a sealing member fitting portion provided on an outer periphery of the inner housing;

an outer housing including a receptacle into which the inner housing is fit;

a plurality of ferrites accommodated respectively in the ferrite accommodating portions of the inner housing, each of the ferrites including an insertion hole through which a male terminal is inserted, the plurality of ferrites being accommodated into an internal accommodation space formed inside by the inner housing and the receptacle in a fit state; and a sealing member fit to the sealing member fitting portion in the outer periphery of the inner housing so that the sealing member is sandwiched between the receptacle and the inner housing over an entire periphery by an inner peripheral surface of the receptacle (30) and a bottom surface of the sealing member fitting portion to suppress water intrusion into the internal accommodation space.

2. A connector comprising:

an inner housing;

an outer housing including a receptacle into which the inner housing is fit;

a plurality of ferrites, each of the plurality of ferrites including an insertion hole through which a male terminal is inserted, the plurality of ferrites being accommodated into an internal accommodation space formed inside by the inner housing and the receptacle of the outer housing in a fit state; and a sealing member sandwiched between the receptacle and the inner housing to suppress water intrusion into the internal accommodation space, wherein the sealing member includes:

ferrite accommodating portions for accommodating the plurality of the ferrites inside;

a first sealing portion held in contact with an inner peripheral surface of the receptacle over an entire periphery; and a second sealing portion in the form of a frame collectively surrounding openings of the ferrite accommodating portions, the second sealing portion being held in contact with a fitting surface of the inner housing over an entire periphery.

* * * * *